United States Patent [19]

Stevens

[11] Patent Number: 4,905,824

[45] **Date of Patent: * Mar. 6, 1990**

[54] POINT-OF-PURCHASE STATIONARY SYSTEM

[75] Inventor: Mark T. Stevens, Centerville, Ohio

[73] Assignee: CSA Inc., Dayton, Ohio

[ * ] Notice: The portion of the term of this patent subsequent to May 23, 2006 has been disclaimed.

[21] Appl. No.: 354,445

[22] Filed: May 19, 1989

Related U.S. Application Data

[63] Continuation of Ser. No. 793,636, Oct. 31, 1985, Pat. No. 4,832,189, and a continuation of Ser. No. 484,637, Apr. 13, 1983, abandoned.

[51] Int. Cl.[4] ..... B65D 85/00

[52] U.S. Cl. ..... 206/215; 53/393

[58] Field of Search ..... 206/449, 45, 44.11, 206/425, 479, 45.33, 813, 214, 215; 53/393

[56] References Cited

U.S. PATENT DOCUMENTS

| | | | |
|---|---|---|---|
| 39,148 | 7/1863 | Isham | 206/449 |
| 185,489 | 12/1876 | Buzby | 206/813 |
| 404,594 | 6/1889 | Bühler | 206/215 |
| 727,211 | 5/1903 | Schweer | 206/215 |
| 910,753 | 1/1909 | Wearer | 206/44.11 |
| 969,135 | 8/1910 | Crabtree | 206/814 |
| 1,014,581 | 1/1912 | Ehmling | 206/215 |
| 1,589,218 | 6/1926 | Pinten | 206/45 |
| 1,663,171 | 3/1928 | Osborn | 206/215 |
| 2,015,910 | 10/1935 | Schimmel | 206/45 |
| 2,192,268 | 3/1940 | Lane et al. | 206/813 |
| 2,755,576 | 7/1956 | Golden | 206/813 |
| 3,442,372 | 5/1969 | Carmichael et al. | 206/497 |
| 3,483,965 | 12/1969 | Rosenblatt et al. | 206/45.33 |
| 3,595,382 | 3/1971 | Hoffer | 206/215 |
| 3,598,677 | 8/1971 | Bergmeister et al. | 206/813 |
| 3,973,674 | 8/1976 | Postlethwaite | 206/444 |
| 4,832,189 | 5/1989 | Stevens | 206/214 |

FOREIGN PATENT DOCUMENTS

| | | | |
|---|---|---|---|
| 669862 | 9/1963 | Canada | 206/449 |
| 2409932 | 9/1975 | Fed. Rep. of Germany | 206/45.33 |
| 2733768 | 2/1979 | Fed. Rep. of Germany | 206/45 |
| 9993 | 12/1923 | Netherlands | 206/214 |
| 322518 | 12/1929 | United Kingdom | 206/215 |

OTHER PUBLICATIONS

Stationery for United States Air Force (no date).

*Primary Examiner*—William Price
*Attorney, Agent, or Firm*—Jacox & Meckstroth

[57] ABSTRACT

A display fixture or rack supports a supply or stacks of letter-size pads and smaller note-size stationery pads in generally vertical positions, and also supports a supply of mailing envelopes in horizontal positions. Each pad includes a stack of paper sheets bonded at the top to a stiff backing card and surrounded by a transparent film. A set of one letter-size pad and one note-size pad is printed with the same multicolor design or artwork to provide the pads of each set with substantially the same appearance, and the artwork on each set of pads is different from the artwork on each of the other sets. All of the pads and envelopes are custom printed in colors coordinated to match the colors of a particular college or university, and the envelopes are located in compartments located below the stacks of note-size pads and between the stacks of letter-size pads.

9 Claims, 2 Drawing Sheets

10
12
13
14
16
17
18
19
21
22
23
24
30
30L
30N
31
31L
31N
32L
32N
33L
33N
34L
34N
35L
35N
38
40
43
44
45
48
49
51
70
A
B
C
D
S
UCLA

POINT-OF-PURCHASE STATIONARY SYSTEM

RELATED APPLICATION

This application is a continuation of application Ser. No. 793,636, filed Oct. 31, 1985, Pat. No. 4,832,189, a continuation of application Ser. No. 484,637, filed Apr. 13, 1983, abandoned.

BACKGROUND OF THE INVENTION

It has been common to manufacture or produce custom stationery for colleges or universities and wherein each stationery sheet carries some identification corresponding to the college or university such as the university name and/or an imprint of a logo or seal or mascot identified with the university. Such stationery is commonly sold by college bookstores which also usually sell ruled or lined paper bonded together at the top and having a cardboard backing to form a pad such as a pad of legal-size or letter-size ruled paper sheets. However, it has been found that the selection of stationery for a particular college or university is usually limited and the stationery is not offered and displayed in a variety of forms and in a compact manner so that each customer may choose conveniently from various designs and sizes of stationery sheets.

SUMMARY OF THE INVENTION

The present invention is directed to an improved stationery system adapted to form a point-of-purchase display in a college bookstore and which provides for conveniently and quickly selecting from various designs and sizes of stationery custom designed and printed with art work corresponding to a particular college. As used herein, the term college includes a university a junior college, military school and any other institution which may desire custom printed stationery. As one feature. the stationery system of the invention provides for selecting from various sets of stationery with each set including a letter-size pad of stationery sheets and a smaller note-size pad of stationery sheets. The sheets of each pad are bonded to a rigid backing card with the artwork on each set of pads being substantially identical, and all of the sets are printed in colors to match the colors of a particular college.

Each stationery pad of the invention is wrapped in a transparent film, and the sets of pads are supported for display in generally vertical positions by a rack which also has compartments under the note-size pads for receiving packages of envelopes printed in colors to match the colors of the stationery sheets. The sizes of the letter-size and note-size pads are such that they may be efficiently printed and die-cut from commonly available sheets or webs of paper having a predetermined standard width.

Other features and advantages of the invention will be apparent from the following description, the accompanying drawings and the appended claims.

DESCRIPTION OF THE PREFERRED EMBODIMENT

Figures 1, 2, 3:
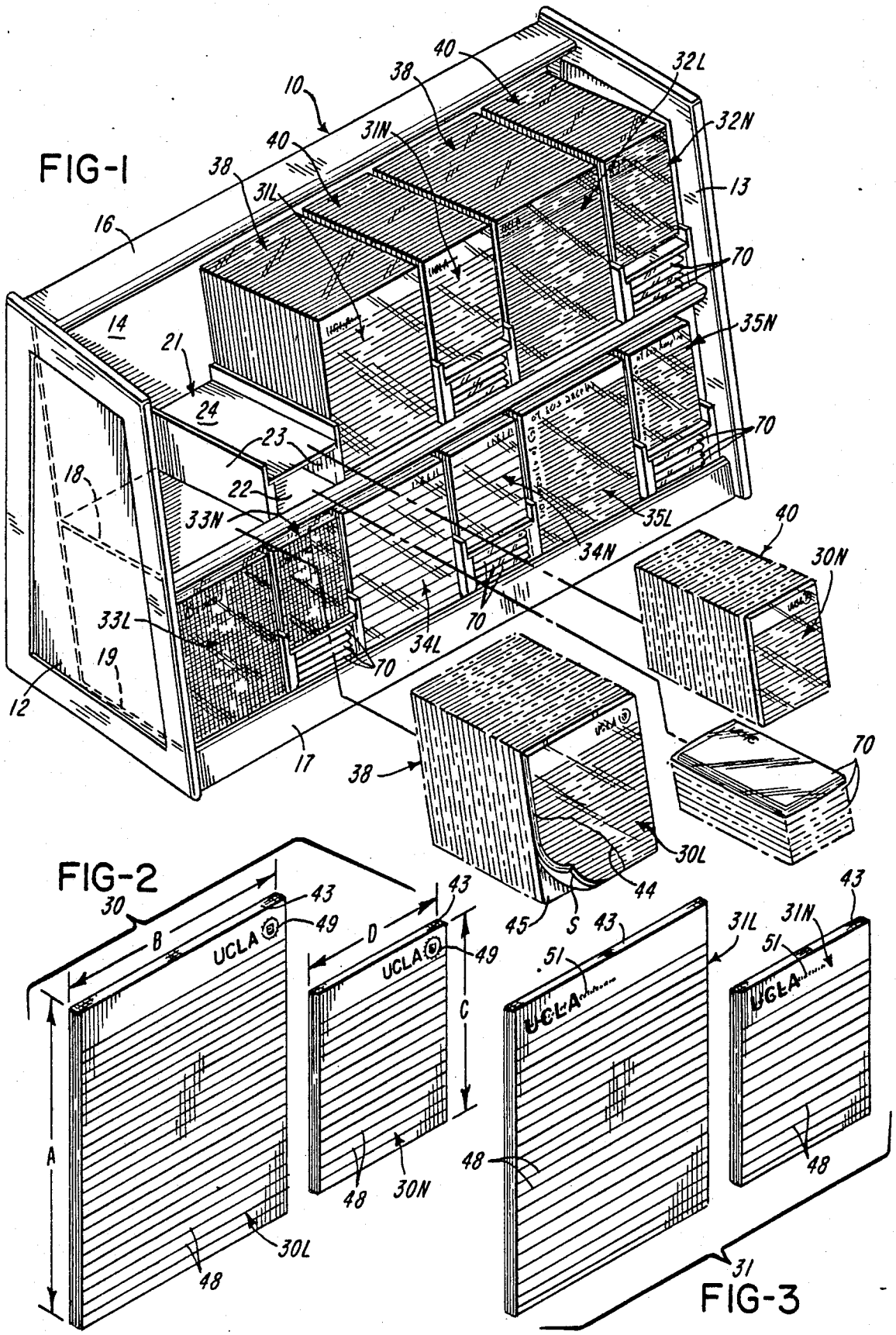
FIG. 1 is a perspective view of a point-of-purchase stationery system constructed in accordance with the invention and having one set of pads and one group of envelope packages exploded from the supporting display fixture or rack.
FIGS. 2–7 are perspective view of the various sets of stationery pads supported for display by the fixture or rack shown in FIG. 1.

FIG. 1 shows a point-of-purchase display fixture or rack 10 preferably constructed of wood and including a pair of trapezoid-shaped end panels or walls 12 and 13 rigidly connected by a slightly inclined back wall 14' a top rail 16' a bottom rail 17' an upper shelf 18 and a lower shelf 15. A series of six inverted U-shaped channels 21 are supported by the upper and lower shelves 18 and 15 and define horizontally extending compartments 22. Each of the channels 21 is formed by a pair of side walls or panels 23 having stepped upper edge portions for receiving a top wall or pane 24 and to define parallel side rails.

The display rack 10 supports a supply of six different stationery sets 30–35 which include corresponding letter-size pads 30L–35L and corresponding note-size pads 30N–35N. The letter-size pads 30L–35L are supported in stacks 38 by the upper and lower shelves 18 and 19 of the rack 10 with the pads slightly inclined, and the note-size pads 30N–35N are supported in stacks 40 by the top walls 24 of the channels 21 with the pads also slightly inclined according to the incline of the back wa 14 of the rack.

Each of the letter-size pads 30L–35L includes a stack of paper sheets S bonded together at the top by a rubber-like binding 43 which also attaches the sheets S to the top of a rigid backing card 45. Each of the note-size pads 30N–35N is similarly constructed, and each of the letter-size and note-size pads is individually wrapped with a clear transparent film 44 of plastics material, as shown in FIG. 1. All of the sets 30–35 of pads are printed in multiple or two colors which correspond to the colors of a particular college, but each set of pads is printed with a different design or artwork from each of the other sets. The note-size pads 30N–35N are substantially two-thirds the size of the letter-size ads 30L–35L. More specifically, each of the letter-size pads has a length A (FIG. 2) of $10\frac{1}{2}$ inches and a width S of 8 inches. Each of the note-size pads has a length C of 7 inches and width D slightly under 5 inches or $4\frac{7}{8}$ inches. These relative sizes permit the paper sheets for all of the pads to be efficiently printed by a multicolor web press with two letter-size sheets and three note-size sheets printed across the width of the web and with the sheets orientated so that their lengths extend across the width of the web.

A typical set of stationery pads constructed in accordance with the invention is illustrated in FIGS. 2–7 without the surrounding film 44. As mentioned above, the sets 30–35 are printed in the same multiple or two colors, for example, the colors of gold and blue which correspond or match the school colors of University of California at Los Angeles. A letter-size pad and a note-size pad of each set are printed with the same art work to provide substantially the same appearance. As illustrated, the art work on the set 30 includes blue lines 48 printed on white paper sheets the "UCLA" is printed in blue, and the seal 49 is printed in gold and blue. The artwork on the set 31 also includes blue lines 48 printed on white paper sheets, "UCLA" printed in gold and "University of California At Los Angeles" 51 printed in blue.

Figure 4:
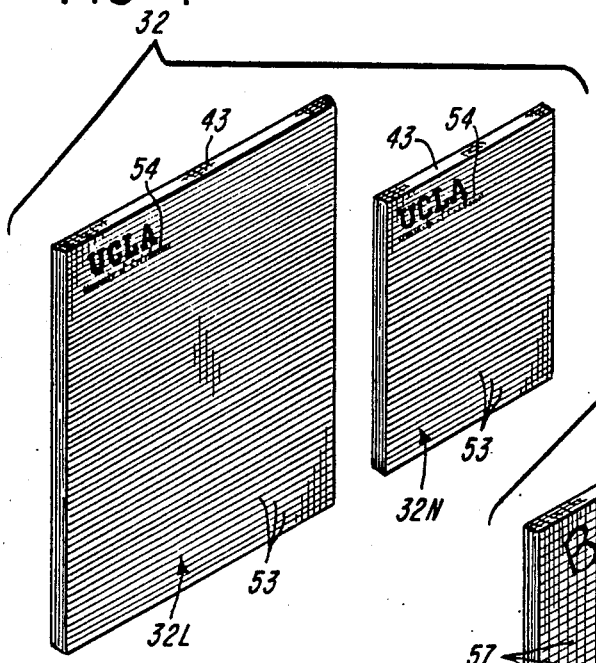
Figure 5:
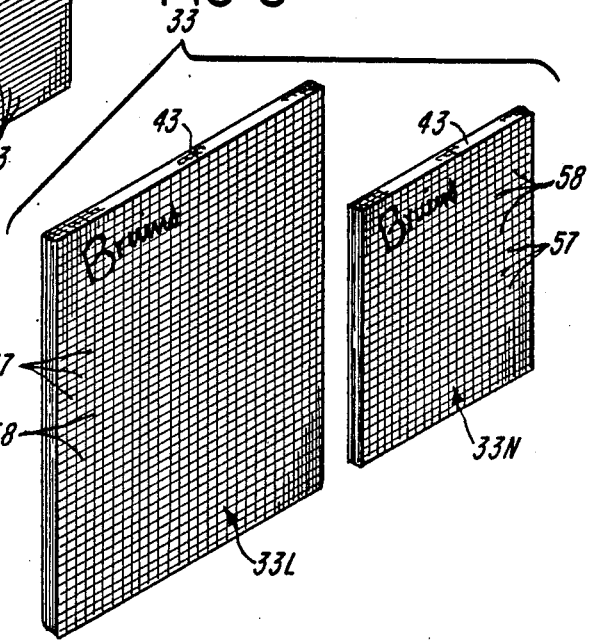

The design or artwork of the stationery set 32 shown in FIG. 4, includes light blue lines 53 which are closely spaced at intervals preferably less than 3 millimeters or about 2 millimeters, and "UCLA" and "University of California at Los Angeles" 54 are printed in blue. The portions of the lines 53 extending through the "UCLA" are printed in gold. The design or artwork of the set 33 illustrated in FIG. 5' includes a pattern of light gold squares 57 printed on white paper sheets so that the crossing lines 58 appear white, and the word "BRUINS" is printed in the colors of gold and blue.

Figure 6:
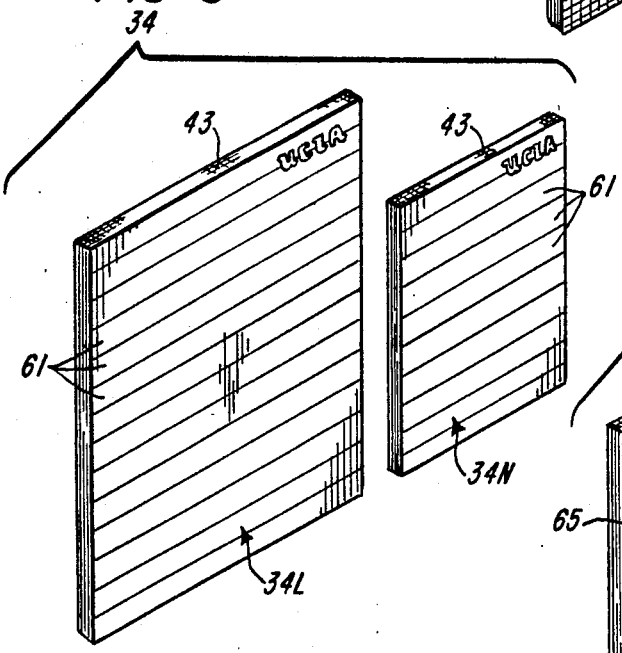
Figure 7:
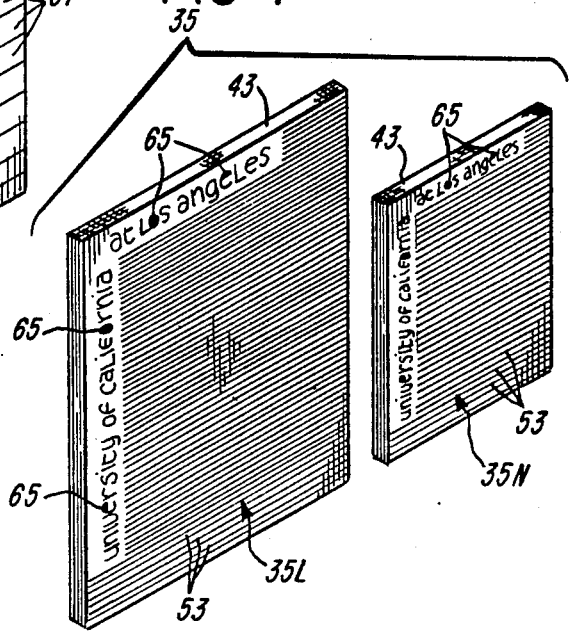

The design or artwork of the stationery pads shown in set 34 of FIG. 6 includes bands 61 printed in blue with the bands at the top of each sheet being very light blue and the bands becoming progressively darker towards the bottom of the sheet. The "UCLA" is printed in gold. The artwork of the sixth set 35 illustrated in FIG. 7' includes light blue lines 53 printed on white paper sheets and "UNIVERSITY OF CALIFORNIA AT LOS ANGELES" is printed in blue and extends along the left side and across the top or around the corner of each sheet. The solid portions 65 in "UNIVERSITY OF CALIFORNIA OF LOS ANGELES" are printed in gold, and the portions 65 on the note-size pad 35N are smaller than the portions 65 on the letter-size pad 35L.

As shown in FIG. 1, a stack of envelope packages 70 are supported within each of the compartments 22 of the rack 10, and each of the envelopes in each of the packages 70 is printed in a relatively light solid color which matches one of the school colors printed on the corresponding or adjacent set of stationery pads. Preferably, the envelopes are packaged with ten envelopes wrapped in film to form a package 70, and several packages 70 are located within each compartment 22.

From the drawings and the above description, it is apparent that a point-of-purchase stationery system constructed in accordance with the present invention provides desirable features and advantages. As one primary feature, the system provides for conveniently selecting stationery pads from pads of different sizes and with different designs or art work each color coordinated to the colors of a particular college. In addition, the various sets of letter-size and note-size stationery pads can be efficiently and economically printed in multiple colors corresponding to the school colors with the various different designs or art work, especially when two letter size sheets and three note-size sheets are printed in multiples across the width of a paper web having a width slightly greater than twice the length of a letter-size pad. The rack 10 also provides for holding a supply and for displaying the sets of stationery pads in a compact space with the envelope packages located below the stacks 40 of note-size pads and between the stacks 38 of letter-size pads.

While the stationery system herein described constitutes a preferred embodiment of the invention, it is to be understood that the invention is not limited to the precise system described, and that changes may be made therein without departing from the scope and spirit of the invention as defined in the appended claims.

The invention having been described, the following is claimed:

1. A point-of-purchase stationery system for use in a store which sells articles to individuals associated with a college or other organization, said system comprising a plurality of letter-size pads of identical size, a plurality of note-size pads of identical size, each of said letter-size pads and each of said note-size pads including a plurality of paper sheets bonded to a backing card, each of said letter-size pads cooperating with one of said note-size pads to form a stationery set, said sheets of each said set of letter-size and note-size pads having custom printed thereon substantially identical multiple color artwork identifying the organization, said custom printed artwork on each said set of said pads having substantially the same color and appearance, each of said note-size pads being substantially smaller in size than the corresponding said letter-size pad, a portion of the artwork on each note-size pad being smaller than the corresponding artwork on the corresponding letter-size pad, said custom printed artwork on said sheets of each said set of pads being substantially different from said custom printed artwork on said sheets of each of the other said sets of pads to form a plurality of different said sets of pads, all of said sets of pads having artwork in the same colors, and means for displaying said sets of pads to provide the individual with a selection from a variety of said custom printed stationery pads associated with the organization while minimizing the costs of producing said pads.

2. A stationery system as defined in claim 1 wherein said means for displaying comprise a rack having a plurality of vertically spaced shelves, and each shelf supporting a plurality of stacks of said letter-size pads and said note-size pads arranged in generally vertical positions.

3. A stationery system as defined in claim 1 and including at least three said sets of said letter-size pads and corresponding note-size pads, and each of said pads is individually wrapped with a transparent film of plastics material.

4. A stationery system as defined in claim 1 wherein said means for displaying comprise a rack supporting multiple stacks of said letter-size pads and said note-size pads in generally vertical positions with at least one stack of said note-size pads disposed between two stacks of said letter-size pads.

5. A stationery system as defined in claim 4 wherein said rack includes means for elevating each of said stacks of said note-size pads.

6. A point-of-purchase stationery system for use in a store which sells articles to individuals associated with a college or other organization, said system comprising at least three letter-size pads of identical size, at least three note-size pads of identical size, each of said letter-size pads and each of said note-size pads including a plurality of paper sheets bonded to a backing card, each of said letter-size pads cooperating with one of said note-size pads to form a stationery set, said sheets of each said set of letter-size and note-size pads having custom printed thereon substantially identical multiple color artwork identifying the organization, said custom printed artwork on each said set of said pads having substantially the same color and appearance, each of said note-size pads being substantially smaller in size than the corresponding said letter-size pad, a portion of the artwork on each note-size pad being smaller than the corresponding artwork on the corresponding letter-size pad, said custom printed artwork on said sheets of each said set of pads being substantially different from said custom printed artwork on said sheets of each of the other said sets of pads to form at least three different said sets of pads, all of said sets of pads having artwork in the same colors, and means for displaying said sets of pads to provide the individual with a selection from a variety of said custom printed stationery pads associated with the organization while minimizing the costs of producing said pads.

7. A method of producing a stationery system for use in a store which sells articles to individuals associated with a college or other organization, said method comprising the steps of custom printing one or more paper webs with different multiple color artwork each identifying the organization and to define a plurality of letter-size sheets of identical size and a plurality of note-size sheets of identical size with a portion of the artwork on the note-size sheets being smaller than the same artwork on the corresponding letter-size sheets, cutting the webs to form a plurality of separate letter-size sheets with identical artwork and a plurality of note-size sheets with the same identical artwork and with the note-size sheets being substantially smaller in size than three letter-size sheets, binding the corresponding letter-size sheets with backing cards to form a plurality of letter-size pads, binding the corresponding note-size sheets with corresponding backing cards to form a plurality of note-size pads, collecting the corresponding letter-size pads and note-size pads to form a plurality of different stationery sets each including one letter-size pads and one note-size pad with custom printed identical artwork thereon, and displaying the stationery sets to provide the individual with a selection from a variety of custom printed stationery pads associated with the organization while minimizing the costs of producing the pads.

8. A method as defined in claim 7 wherein at least three of the sets of letter-size pads and corresponding note-size pads are printed and formed.

9. A method as defined in claim 7 wherein the sets of pads are displayed in generally vertical positions and are arranged in stacks on a rack with one stack of note-size pads disposed between two stacks of the letter-size pads.

* * * * *